United States Patent [19]

Schorfheide

[11] Patent Number: 4,613,424

[45] Date of Patent: Sep. 23, 1986

[54] CATALYTIC REFORMING PROCESS

[75] Inventor: James J. Schorfheide, Baton Rouge, La.

[73] Assignee: Exxon Research and Engineering Co., Florham Park, N.J.

[21] Appl. No.: 773,679

[22] Filed: Sep. 9, 1985

Related U.S. Application Data

[63] Continuation-in-part of Ser. No. 686,452, Dec. 26, 1984, abandoned.

[51] Int. Cl.[4] ..... C10G 35/06

[52] U.S. Cl. ..... 208/65; 208/138

[58] Field of Search ..... 208/65, 138

[56] References Cited

U.S. PATENT DOCUMENTS

| | | | |
|---|---|---|---|
| 3,006,841 | 10/1961 | Haensel | 208/138 |
| 3,415,737 | 12/1968 | Kluksdahl | 208/138 |
| 3,424,669 | 1/1969 | Carter et al. | 208/138 |
| 3,669,875 | 6/1972 | Plank et al. | 208/138 |
| 4,166,024 | 8/1979 | Swan | 208/139 |

*Primary Examiner*—Curtis R. Davis

*Attorney, Agent, or Firm*—Llewellyn A. Proctor

[57] ABSTRACT

In a process wherein, in a series of reforming zones, or reactors, each of which contains a bed, or beds of a sulfur-sensitive polymetallic platinum-containing catalyst, the beds of catalyst are contacted with a hydrocarbon or naphtha feed, and hydrogen, at reforming conditions to produce a hydrocarbon, or naphtha product of improved octane, the improvement wherein, at start-up, sulfur is added to the tail reactor of the series, and excluded from the lead reactor. Increased hydrogen purity, aromatics, and $C_5+$ liquid yields are obtained, and there is less gas make.

12 Claims, 2 Drawing Figures

CATALYTIC REFORMING PROCESS

RELATED APPLICATIONS

Figure 1:
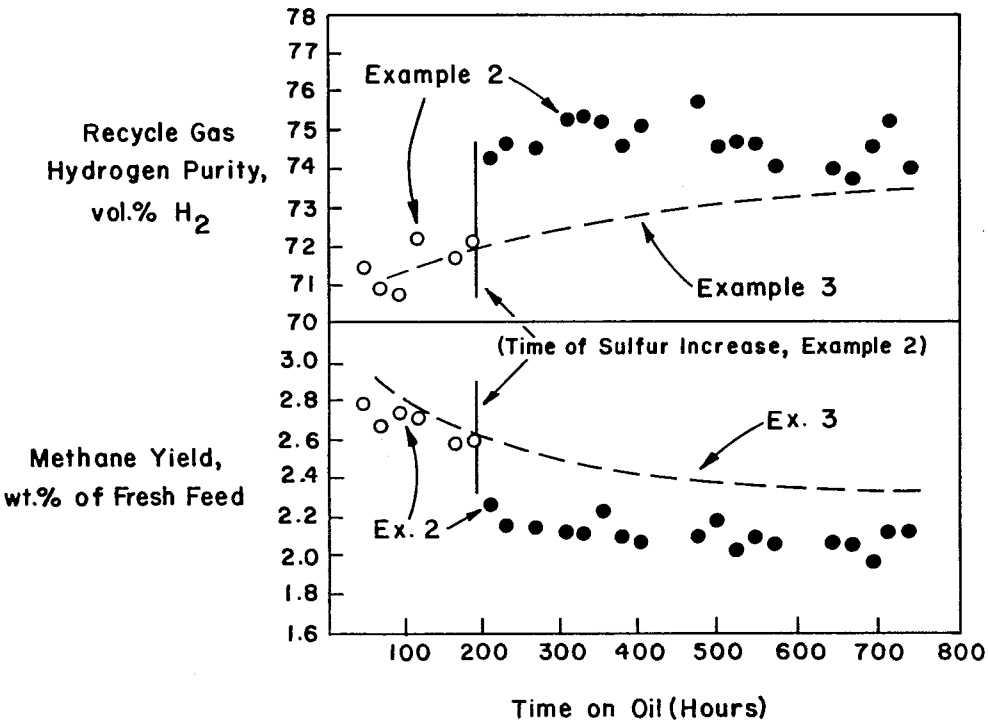

This is a continuation-in-part of application Ser. No. 686,452 filed Dec. 26, 1984, now abandoned.

BACKGROUND OF THE INVENTION AND PRIOR ART

I. Field of the Invention

This invention relates to a process for reforming with sulfur-sensitive, polymetallic platinum-containing catalysts wherein sulfur is added to an intermediate or final reactor, or reaction zone, or zones, and excluded from the initial reactor, or reaction zone, of the series.

II. Background and Problems

Catalytic reforming, or hydroforming, is a well established industrial process employed by the petroleum industry for improving the octane quality of naphthas or straight run gasolines. In reforming, a multi-functional catalyst is employed which contains an acid component and a metal hydrogenation-dehydrogenation (hydrogen transfer) component, or components, substantially atomically dispersed upon the surface of a porous, inorganic oxide support, notably alumina. Noble metal catalysts, notably of the platinum type, are currently employed as metal hydrogenation-dehydrogenation components, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being progressively deposited on the catalyst as reforming is continued.

In a reforming operation, one or a series of reactors, or a series of reaction zones, are employed. Typically, a series of reactors are employed, e.g., three or four reactors, these constituting the heart of the reforming unit. Each reforming reactor is generally provided with a fixed bed, or beds, of the catalyst which receive downflow feed, and each is provided with a preheater or interstage heater. A naphtha feed, with hydrogen, or recycle hydrogen gas, is concurrently passed through a preheat furnace and reactor, and then in sequence through subsequent interstage heaters and reactors of the series. The product from the last reactor is separated into a liquid fraction, and a vaporous effluent. The former is recovered as a $C_5+$ liquid product. The latter is a gas rich in hydrogen, and usually contains small amounts of normally gaseous hydrocarbons, from which hydrogen is separated and recycled as "recycle gas" to the process to minimize coke production. In conventional operations, the recycle gas, which generally contains moisture and hydrogen sulfide impurities, is passed through a recycle gas drier which removes much of the moisture and hydrogen sulfide prior to the introduction of the recycle gas into the first reactor of the series.

The sum-total of the reforming reactions, supra, occurs as a continuum between the first and last reactor of the series, i.e., as the feed enters and passes over the first fixed catalyst bed of the first reactor and exits from the last fixed catalyst bed of the last reactor of the series.

The reactions which predominate between the several reactors differ dependent principally upon the nature of the feed, and the temperature employed within the individual reactors. In the initial reaction zone, or first reactor, which is maintained at a relatively low temperature, the primary reaction involves the dehydrogenation of naphthenes to produce aromatics. The isomerization of naphthenes, notably $C_5$ and $C_6$ naphthenes, also occurs to a considerable extent. Most of the other reforming reactions also occur, but only to a lesser, or smaller extent. There is relatively little hydrocracking, and very little olefin or paraffin dehydrocyclization occurs in the first reactor. Naphthene dehydrogenation is an endothermic reaction, and consequently the reactions in the first reactor are extremely endothermic, generally accounting for as much as 2/5 to 3/5 of the total observed temperature difference ($\Delta T$) across the several catalyst beds contained in the several reactors of the series. Within the intermediate reactor(s), or reaction zone(s), the temperature is maintained somewhat higher than in the first, or lead reactor of the series, and it is believed that the primary reactions in the intermediate reactor, or reactors, involve the isomerization of naphthenes and paraffins. Where, e.g., there are two reactors disposed between the first and last reactor of the series, it is believed that the principal reaction involves the isomerization of naphthenes, normal paraffins and isoparaffins. Some dehydrogenation of naphthenes may, and usually does occur, at least within the first of the intermediate reactors. There is usually some hydrocracking, at least more than in the lead reactor of the series, and there is more olefin and paraffin dehydrocyclization. The net effect of the reactions which occur in this reactor are endothermic, and though the temperature drop between the feed inlet and feed outlet is not as large as in that of the initial reactor (even though the second reactor generally contains a larger catalyst charge than the initial reactor), it is nonetheless considerable. The third reactor of the series, or second intermediate reactor, is generally operated at a somewhat higher temperature than the second reactor of the series. It is believed that the naphthene and paraffin isomerization reactions continue as the primary reaction in this reactor, but there is very little naphthene dehydrogeneration. There is a further increase in paraffin dehydrocyclization, and more hydrocracking. The net effect of the reactions which occur in this reactor is also endothermic, though the temperature drop between the feed inlet and feed outlet is smaller than in the first two reactors. In the final reaction zone, or final reactor, which is typically operated at the highest temperature of the series, it is believed that paraffin dehydrocyclization, particularly the dehydrocyclization of the short chain, notably $C_6$ and $C_7$ paraffins, is the primary reaction. The isomerization reactions continue, and there is more hydrocracking and coke formation in this reactor than in any of the other reactors of the series. The net effect of the reactions which occur in this reactor is also generally endothermic.

Platinum is widely commercially used in the production of reforming catalysts, and platinum-on-alumina catalysts have been commercially employed in refineries for the last few decades. In more recent years polymetallic catalysts have been used. These are catalysts wherein additional metallic components have been added to platinum as promoters to further improve the activity or selectivity, or both, of the basic platinum catalyst, e.g., iridium, rhenium, tin, and the like. Such catalysts possess superior activity, or selectivity, or both, as contrasted with the basic platinum catalyst. Platinum-rhenium catalysts by way of example possess admirable selectivity as contrasted with platinum catalysts, selectivity being defined as the ability of the catalyst to produce high yields of $C_5+$ liquid products with concurrent low production of normally gaseous hydrocarbons, i.e., methane and other gaseous hydrocarbons, and coke.

The activity of the catalyst gradually declines due to the build-up of coke. Coke formation is believed to result from the deposition of coke precursors such as anthracene, coronene, ovalene, and other condensed ring aromatic molecules on the catalyst, these polymerizing to form coke. During operation, the temperature of the process is gradually raised to compensate for the activity loss caused by the coke deposition. Eventually, however, temperature increases cannot compensate for the loss in catalytic activity and hence it becomes necessary to reactivate the catalyst. Consequently, in all processes of this type the catalyst must necessarily be periodically regenerated by burning off the coke at controlled conditions.

Two major types of reforming are generally practiced in the multi reactor units, both of which necessitate periodic reactivation of the catalyst, the initial sequence of which requires regeneration, i.e., burning the coke from the catalyst. Reactivation of the catalyst is then completed in a sequence of steps wherein the agglomerated metal hydrogenation-dehydrogenation components are atomically redispersed. In the semi-regenerative process, a process of the first type, the entire unit is operated by gradually and progressively increasing the temperature to maintain the activity of the catalyst caused by the coke deposition, until finally the entire unit is shut down for regeneration, and reactivation, of the catalyst. In the second, or cyclic type of process, the reactors are individually isolated, or in effect swung out of line by various manifolding arrangements, motor operated valving and the like. The catalyst is regenerated to remove the coke deposits, and then reactivated while the other reactors of the series remain on stream. A "swing reactor" temporarily replaces a reactor which is removed from the series for regeneration and reactivation of the catalyst, until it is put back in series.

Change in the total, or overall, $\Delta T$ is a good indication of changing performance in the reactors during an operating run, and correlates well with the ability of the reaction system to produce reformate octane value; which normally decreases throughout the run. In cyclic operations, in particular, the decline in the temperature drop across a catalyst bed is sometimes used as a criterion for selecting the next reactor candidate for regeneration of its catalyst charge.

Essentially all petroleum naphtha or synthetically derived naphtha feeds contain sulfur, a well known catalyst poison which can gradually accumulate upon and poison reforming catalysts. Most of the sulfur, because of this adverse effect, is removed from feed naphthas, e.g., by hydrofining and subsequent contact with guard beds packed or filled with sulfur adsorbents. The polymetallic reforming catalysts are particularly sulfur-sensitive, and particularlly susceptible to sulfur poisoning. The presence of even small and virtually infinitesimal amounts of sulfur in either the naphtha feed or hydrogen recycle gas, or both, it has been observed, adversely affects the process, and performance of the catalysts. Whereas various improvements have been made in adsorbents, and in the operation of guard beds to eliminate sulfur from the naphtha feed and hydrogen recycle gas, the complete elimination of sulfur from the naphtha does not appear practical, if indeed possible, and sulfur inevitably appears in the process. The effect of sulfur in the naphtha, even in concentration ranging only a few parts per million is that, in the overall reforming operation, the yield of hydrogen, aromatics, and $C_5+$ liquid yield decreases as sulfur builds up and increases in the system, there is an increase in the rate of catalyst deactivation, and in the total production of $C_1$–$C_4$ light gases.

III. Objects

It is, accordingly, the primary objective of this invention to provide a new and improved process useful in the operation of reforming units which employ highly active sulfur-sensitive polymetallic platinum-containing catalyst to produce high octane gasolines.

A specific object is to provide a novel process as characterized, but particularly a start-up procedure which will provide improved hydrogen purity and aromatics production, increased $C_5+$ liquid yield, and decreased $C_4-$ light gas production in the operation of a reforming unit.

IV. The Invention

These objects and others are achieved in accordance with the present invention, embodying a process wherein, in a series of reforming zones, or reactors, each of which contains a bed, or beds of catalyst, the catalyst in each of which is constituted of a sulfur-sensitive, polymetallic platinum-containing catalyst which contains little or no coke, and naphtha, and hydrogen, are introduced into the lead reactor, passed in series from one reactor to another, and reacted at reforming conditions, sulfur is introduced into the final or tail reactor of the series to provide and maintain sulfur in concentration within the naphtha to said final reactor ranging from about 0.5 parts per million, based on the weight of the naphtha feed (wppm), to about 20 wppm, preferably from about 0.5 wppm to about 8 wppm, while excluding sulfur from the lead reactor of the series. The sulfur can be added to an intermediate reactor of the series, or added directly to the final reactor, preferably the latter. It has been found that the introduction, or addition of sulfur to the final reactor, or reaction zone of the series, during start-up, or that early portion of the operating cycle when the catalyst contains little or no coke, relative to the total operating cycle throughout which coke gradually, and progressively builds up and accumulates on the catalyst, provides improved hydrogen, aromatics, and $C_5+$ liquid yields, and reduced $C_1$–$C_4$ light gas make.

In accordance with this invention, sulfur is excluded, or its presence minimized, during start-up with a fresh or regenerated catalyst from the lead reactor of the series wherein naphthene dehydrogenation is the predominant reaction. A higher level of sulfur is maintained during this period in the final reactor of the series wherein paraffin and olefin dehydrocyclization are the predominant reactions. In carrying out such operation, sulfur is injected during this period into an intermediate or the tail reactor, preferably the latter, as hydrogen sulfide, or compound decomposable in situ to form hydrogen sulfide, in amount sufficient to provide sulfur in concentration ranging from about 0.5 wppm to about 20 wppm, preferably 0.5 wppm to about 8 wppm, based on naphtha feed. Sulfur is then removed from the product hydrogen gas from the last reactor of the series, suitably by passage of the gas through a sulfur adsorbent, and the gas is recycled. The gas is recycled to the lead reactor where it is added with fresh essentially sulfur-free naphtha. The essentially sulfur-free naphtha feed, and hydrogen, entering the lead reactor will provide a concentration of less than 0.5 wppm within the naphtha feed to the first reactor, and preferably no more than about 0.1 wppm sulfur. It is found that hydrogen, aromatics and $C_5+$ liquid yields are improved, and reduced $C_1$–$C_4$ light gas make up to such point in time that the catalyst in the final reactor, or reaction zone, contains no more than about 10 percent coke, based on the total weight of the catalyst, deposited thereon; and preferably no more than about 5 percent coke deposited upon the catalyst. This period corresponds generally from about 5 to about 60 percent of the operating cycle, and preferably from about 5 percent to about 30 percent of the total operating cycle which begins at start-up, or when the catalyst is first placed on-oil.

The catalyst employed in accordance with this invention is necessarily constituted of composite particles which contain, besides a carrier or support material, a hydrogenation-dehydrogenation component, or components, a halide component and, preferably, the catalyst is sulfided. The support material is constituted of a porous, refractory inorganic oxide, particularly alumina. The support can contain, e.g., one or more of alumina, bentonite, clay, diatomaceous earth, zeolite, silica, activated carbon, magnesia, zirconia, thoria, and the like; though the most preferred support is alumina to which, if desired, can be added a suitable amount of other refractory carrier materials such as silica, zirconia, magnesia, titania, etc., usually in a range of about 1 to 20 percent, based on the weight of the support. A preferred support for the practice of the present invention is one having a surface area of more than 50 $m^2/g$, preferably from about 100 to about 300 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30 to 300 Å.

The metal hydrogenation-dehydrogenation component, or components, includes platinum, and one or more of iridium, rhenium, palladium, rhodium, tin, and tungsten. Preferably, the hydrogenation-dehydrogenation component, or components, are platinum and iridium or rhenium, or platinum and both iridium and rhenium. The hydrogenation-dehydrogenation component, or components, can be composited with or otherwise intimately associated with the porous inorganic oxide support or carrier by various techniques known to the art such as ion-exchange, coprecipitation with the alumina in the sol or gel form, and the like. For example, the catalyst composite can be formed by adding together suitable reagents such as a salt of platinum and a salt of rhenium and ammonium hydroxide or carbonate, and a salt of aluminum such as aluminum chloride or aluminum sulfate to form aluminum hydroxide. The aluminum hydroxide containing the salts of platinum and rhenium can then be heated, dried, formed into pellets or extruded, and then calcined in nitrogen or other nonagglomerating atmosphere. The metal hydrogenation components can also be added to the catalyst by impregnation, typically via an "incipient wetness" technique which requires a minimum of solution so that the total solution is absorbed, initially or after some evaporation.

It is preferred to deposit the platinum and iridium or rhenium metals, or both, and additional metals used as promoters, if any, on a previously pilled, pelleted, beaded, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic components.

Platinum in absolute amount is usually supported on the carrier within the range of from about 0.05 to 3 percent, preferably from about 0.2 to 1 percent, based on the weight of the catalyst (dry basis). Rhenium, in absolute amount, is also usually supported on the carrier in concentration ranging from about 0.05 to about 3 percent, preferably from about 0.3 to about 1 percent, based on the weight of the catalyst (dry basis). Iridium, or metal other than platinum and rhenium, when employed, is also added in concentration ranging from about 0.05 to about 3 percent, preferably from about 0.2 to about 1 percent, based on the weight of the catalyst (dry basis). The absolute concentration of each, of course, is preselected to provide the desired ratio of rhenium:platinum for a respective reactor of the unit, as heretofore expressed.

In compositing the metals with the carrier, essentially any soluble compound can be used, but a soluble compound which can be easily subjected to thermal decomposition and reduction is preferred, for example, inorganic salts such as halide, nitrate, inorganic complex compounds, or organic salts such as the complex salt of acetylacetone, amine salt, and the like. When, e.g., platinum is deposited on the carrier, platinum chloride, platinum nitrate, chloroplatinic acid, ammonium chloroplatinate, potassium chloroplatinate, platinum polyamine, platinum acetylacetonate, and the like, are preferably used.

To enhance catalyst performance in reforming operations, it is also required to add a halogen component to the catalysts, fluorine and chlorine being preferred halogen components. The halogen is contained on the catalyst within the range of 0.1 to 3 percent, preferably within the range of about 0.3 to about 1.5 percent, based on the weight of the catalyst. When using chlorine as halogen component, it is added to the catalyst within the range of about 0.2 to 2 percent, preferably within the range of about 0.5 to 1.5 percent, based on the weight of the catalyst. The introduction of halogen into catalyst can be carried out by any method at any time. It can be added to the catalyst during catalyst preparation, for example, prior to, following or simultaneously with the incorporation of the metal hydrogenation-dehydrogenation component, or components. It can also be introduced by contacting a carrier material in a vapor phase or liquid phase with a halogen compound such as hydrogen fluoride, hydrogen chloride, carbon tetrachloride, or the like.

The catalyst is dried by heating at a temperature above about 80° F., preferably between about 150° F. and 300° F., in the presence of nitrogen or oxygen, or both, in an air stream or under vacuum. The catalyst is calcined at a temperature between about 500° F. to 1200° F., preferably about 500° F. to 1000° F., either in the presence of oxygen in an air stream or in the presence of an inert gas such as nitrogen.

Sulfur is a highly preferred component of the catalysts, the sulfur content of the catalyst generally ranging to about 0.2 percent, preferably from about 0.03 percent to about 0.15 percent, based on the weight of the catalyst (dry basis). A fresh reforming catalyst is generally sulfided prior to its being placed on-oil, and since sulfur is lost during reforming, the catalyst is again sulfided during catalyst regeneration. The sulfur can be added to the catalyst by conventional methods, suitably by breakthrough sulfiding of a bed of the catalyst with a sulfur-containing gaseous stream, e.g., hydrogen sulfide in hydrogen, performed at temperatures ranging from about 350° F. to about 1050° F. and at pressures ranging from about 1 to about 40 atmospheres for the time necessary to achieve breakthrough, or the desired sulfur level.

The feed or charge stock can be a virgin naphtha cracked naphtha, a naphtha from a coal liquefaction process, a Fischer-Tropsch naphtha, or the like. Typical feeds are those hydrocarbons containing from about 5 to 12 carbon atoms, or more preferably from about 6 to about 9 carbon atoms. Naphthas, or petroleum fractions boiling within the range of from about 80° F. to about 450° F., and preferably from about 125° F. to about 375° F., contain hydrocarbons of carbon numbers within these ranges. Typical fractions thus usually contain from about 15 to about 80 vol. % paraffins, both normal and branched, which fall in the range of about $C_5$ to $C_{12}$, from about 10 to 80 vol. % of naphthenes falling within the range of from about $C_6$ to $C_{12}$, and from 5 through 20 vol. % of the desirable aromatics falling within the range of from about $C_6$ to $C_{12}$.

The reforming runs are initiated by adjusting the hydrogen and feed rates, and the temperature and pressure to operating conditions. The run is continued at optimum reforming conditions by adjustment of the major process variables, within the ranges described below:

| Major Operating Variables | Typical Process Conditions | Preferred Process Conditions |
|---|---|---|
| Pressure, psig | 50–750 | 100–500 |
| Reactor Temp., °F. | 800–1200 | 850–1000 |
| Recycle Gas Rate, SCF/B | 1000–10,000 | 1500–5000 |
| Feed Rate, W/Hr/W | 0.5–10 | 1–5 |

The invention will be more fully understood by reference to the following comparative data illustrating its more salient features. All parts are given in terms of weight except as otherwise specified.

A rhenium promoted platinum catalyst (0.3 wt. % Pt/0.3 wt. % Re) obtained from a catalyst manufacturer was employed in the several reactors of the reforming units used in conducting the following runs. The catalyst was reduced and presulfided by contact with an admixtxure of 300–500 vppm (ppm by volume) $H_2S$ in hydrogen at 700°–850° F. until $H_2S$ breakthrough at the reactor outlet, a treatment sufficient to deposit 0.08–0.10 wt. % sulfur on the catalyst initially charged to the unit.

Inspections on the petroleum virgin naphtha feedstock used in the test for conducting the run described under Example 1, and the naphtha feedstock employed for conducting the runs described under Examples 2,3 and 4 are given in the table immediately below.

TABLE

| | Example 1 Feedstock | Examples 2,3 & 4 Feedstock |
|---|---|---|
| API Gravity | 56.2 | 59.7 |
| Average Mol. Wt. | 108 | 108 |
| Nitrogen, wppm | <1 | <1 |
| ASTM Distillation | | |
| IBP °F. | 180 ± 2 | 181 ± 2 |
| 5 | 207 | 196 |
| 10 | 211 | 204 |
| 50 | 243 | 241 |
| 90 | 297 | 310 |
| 95 | 309 ± 5 | 328 |
| FBP | 323 ± 10 | 340 ± 10 |

The following demonstration run, Example 1, illustrates the detrimental effects of feed-borne sulfur on catalyst in the lead reactor position and net overall reforming unit performance.

EXAMPLE 1

A commercial reforming unit with three onstream reactors in series, each containing a platinum-rhenium catalyst (0.3 wt. % Pt/0.3 wt. % Re) in which less than eleven percent of the total onstream catalyst charge was contained in the first of the three reactors, was employed to process eighteen thousand barrels per day of naphtha of average molecular weight = 108 and specific gravity (60/60° F.) = 0.754. During the run, after continuous operation to a point at which the catalyst in the tail reactor was estimated to have accumulated from 7 to 8 weight percent coke, the feed sulfur level was increased from an initial level of less than 0.3 wppm sulfur in feed to 1.0 wppm sulfur in feed. Although operating at the lowest average temperature of the three reactors, and containing the smallest amount of catalyst, performance of the initial reactor, or reactor in which the incoming hydrocarbon feedstock is first contacted with catalyst, was observed to undergo a decrease in the temperature drop between the reactor inlet and outlet, indicating a change in the nature or extent of reactions taking place within the catalyst bed. Within three days of the increase in sulfur level, temperature drop of the lead reactor was observed to decrease from 97° F. to 77° F. while average temperature in the catalyst bed increased 10° F. This, as would be expected, resulted in an increased rate of catalyst deactivation, which is highly temperature dependent. Temperature differences between the inlet and outlet of the second and third reactors during this time remained essentially unchanged at 84±1° F. and 16±1° F., respectively. Overall unit performance, as indicated by the total temperature drop across all reactors, deteriorated from 197+ F. temperature drop to 177° F. temperature drop. This apparent decrease in unit performance was corroborated by an observed drop in reforming unit hydrogen yield from 1.70 weight percent of feed before the sulfur increase to 1.60 weight percent hydrogen yield afterward, and an approximate 10 percent decrease in unit activity, or a drop in reformate octane of 0.8 RONC at the conditions at which the unit was operating.

The following Example 2 substantiates the large sensitivity of overall unit performance to deteriorations in the lead reactor catalyst, showing that the harmful effects of feed-borne sulfur can be prevented if damage to the catalyst in the lead reactor position is avoided.

EXAMPLE 2

A first pilot plant run was conducted in which a coke-free catalyst of the same composition employed in the preceding demonstration was contained in a reforming unit employing three onstream reactors in series in the same proportions as described in the preceding demonstration. Process conditions of the pilot plant operation were the same as those of the preceding run, 360±10 psig operating pressure and 3200±200 SCF/B recycle gas rate. The reforming unit in which this evaluation was made permitted adiabatic operation in each of the individual reactors, or the use of an adjustable external heat control means such that a temperature profile could be imposed. After startup the adiabatic temperature profiles were permitted to develop in all reactors while the sulfur level of the incoming naphtha feedstock was maintained at a constant level of 0.3 wppm. After eight days, at which time the catalyst in all reactors had accumulated less than 4 weight percent coke, as determined from previous tests conducted at the same conditions, feedstock sulfur level was increased to 1.5 wppm. To examine the effects of this change without the perturbational effects of increased average temperature in the first reactor catalyst bed, the adiabatic temperature drop which existed in the first reactor catalyst bed before the sulfur level increase was maintained after the increase by means of an adjustable external heat control. This prevented an increased average bed temperature and accelerated rate of deactivation in the lead reactor, while permitting the changed sulfur level to manifest its effects on the catalyst charge contained in the second and third onstream reactors.

Figure 2:
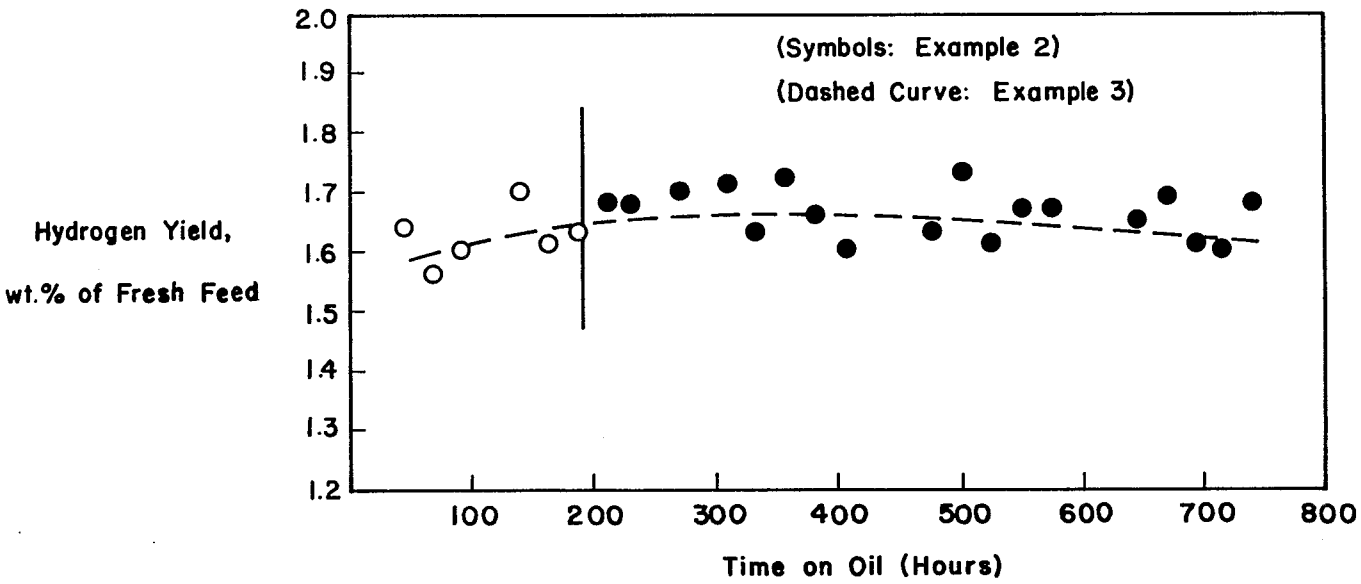

The results of the run are graphically depicted as circular points by reference to FIG. 1. As in the preceding demonstration, there was no observed change in the temperature drop between the inlet and outlet of the second and third reactors. Unlike the preceding demonstration, however, there was a substantial improvement in the purity of the hydrogen-containing recycle gas. In less than twenty-four hours after the sulfur level increase, the hydrogen content of gas from the reactor effluent product separator vessel, maintained at constant temperature and pressure, was observed to increase by 2 volume percent. The yield of methane, the principal impurity which remains in the excess separator drum gas after downstream purification for use in other hydrocarbon processes in an integrated refinery, decreased by roughly one-sixth, as also shown in FIG. 1. There was no loss in hydrogen yield after the sulfur level increase. This is illustrated by the data shown in FIG. 2. That the additional sulfur added to the system was present throughout both the second and third reactors, and not, in view of the small total mass involved, merely adsorbed on a portion of the catalyst bed, was confirmed by careful measurements of the hydrogen sulfide content of the separator drum overhead gas.

The following Example 3, when compared with the preceding examples, shows that the presence of feed-borne sulfur early in the unit operating cycle, when the catalyst contains no more than about 10 weight percent carbon, can in fact be advantageous when damage to the lead position catalyst is avoided.

EXAMPLE 3

A second pilot plant run identical to that described in Example 2 was carried out as in the first pilot plant run, the only difference between the two runs being that the level of sulfur in this second, simultaneous control test was maintained at 0.3 wppm throughout. The results obtained in this second pilot plant run are superimposed on the graphs depicted in FIGS. 1 and 2 as dashed lines, and reference is made to these figures. A comparison of results from these two evaluations reveals that the incremental sulfur added to the second and third reactors of Example 2 while preventing damage to catalyst in the lead reactor is, in fact, advantageous. FIG. 1 illustrates the higher hydrogen purity and lower methane yield of the performance obtained in the first pilot plant run. These benefits, as shown by reference to FIG. 2, have been realized without any disadvantageous loss of hydrogen yield. The overall unit activities, or ability to product high-octane reformate at a given set of conditions, of Examples 2 and 3 were equal both at the time of incremental sulfur addition in Example 2 and for at least ten days afterward.

The following Example 4 confirms that these benefits are enjoyed during the early portions of the operating cycle between regenerations, up to the time that the catalyst contains about 10 weight percent carbon.

EXAMPLE 4

The first and second pilot plant runs (Examples 2 and 3) were continued past the times graphically depicted in the figures. The inlet temperatures of the reactors in each evaluation were increased, as necessary, to compensate for catalyst deactivation and maintain constant reformate product octane value. The temperature drop across the first reactor catalyst beds was kept equal to ensure that any observed differences between the two runs would be manifestations of the effects of sulfur addition on the second and third onstream reactors. It was found that the performance advantages obtained in the first pilot plant run did not extend much beyond the times shown in the illustrating figures. After about twenty days on oil, a slight activity difference between the two pilot plant runs began to be observed. This difference grew, of course, as temperatures were increased and the rates of deactivation accelerated. After about forty days on oil, the hydrogen purities of separator drum overhead gas were the same. After about fifty-five days on oil, a difference in the weight percent hydrogen yields of the two runs began to develop. To provide assurances of data integrity and useful extended performance results, the runs were continued until catalyst activity had in each case declined to one-fourth of its initial, start-of-run value. The runs begun as described in Examples 2 and 3 were terminated after about three and slightly greater than five months, respectively. From the multitude of measurements made over the course of these evaluations, it was found that the benefits obtained in the first pilot plant run are enjoyed during the early portions of the operating cycle, when the reforming catalyst contains up to about 10 weight percent carbon, or coke.

Having described the invention, what is claimed is:

1. In a process for improving the octane quality of a naphtha in a reforming unit comprised of a plurality of serially connected reactors, inclusive of a lead reactor and one or more subsequent reactors, each of which contains a sulfur-sensitive polymetallic platinum-containing catalyst which contains sulfur in concentration ranging from 0.03 to about 0.2 percent, based on the weight of the catalyst, and coke in concentration ranging up to about 10 percent, based on the weight of the catalyst, naphtha and hydrogen being introduced into the lead reactor and flowing in sequence from one reactor to the next subsequent reactor of the series contacting the catalyst at reforming conditions, the improvement comprising, introducing sulfur to the tail reactor of the series and maintaining therein, as a component of the naphtha, sulfur in concentration ranging from 0.5 wppm to about 20 wppm, based on the weight of the naphtha feed, while maintaining the concentration of sulfur in the feed naphtha entering the lead reactor below 0.5 wppm.

2. The process of claim 1 wherein the concentration of sulfur maintained in the naphtha feed to the tail reactor ranges from about 0.5 wppm to about 8 wppm.

3. The process of claim 1 wherein the catalyst of the tail reactor contains from about 0.05 to about 3 weight percent platinum and about 0.05 to about 3 weight percent rhenium.

4. The process of claim 3 wherein the catalyst of the tail reactor contains from about 0.2 to about 1 weight percent platinum and from about 0.3 to about 1 weight percent rhenium.

5. The process of claim 1 wherein the catalyst of the tail reactor contains from about 0.05 to about 3 weight percent platinum and from about 0.05 to about 3 weight percent iridium.

6. The process of claim 5 wherein the catalyst of the tail reactor contains from about 0.2 to about 1 weight percent platinum and from about 0.2 to about 1 weight percent iridium.

7. The process of claim 1 wherein the catalyst of the tail reactor contains platinum, rhenium, and iridium.

8. The process of claim 3 wherein the catalyst of the tail reactor contains from about 0.1 to about 3 weight percent halogen.

9. The process of claim 3 wherein the catalyst of the tail reactor contains from about 0.5 to about 1.5 weight percent halogen.

10. The process of claim 3 wherein the catalyst of the tail reactor is sulfided, and contains from about 0.03 to about 0.15 weight percent sulfur.

11. The process of claim 1 wherein the naphtha feed to the tail reactor contains from about 0.5 wppm to about 8 wppm sulfur, and the naphtha feed to the lead reactor contains no more than about 0.1 wppm sulfur.

12. The process of claim 1 wherein the sulfur component on the catalyst within the several reactors of the series ranges from about 0.03 percent to about 0.15 percent.

* * * * *

UNITED STATES PATENT AND TRADEMARK OFFICE

CERTIFICATE OF CORRECTION

PATENT NO. : 4,613,424

DATED : September 23, 1986

INVENTOR(S) : James J. Schorfheide

It is certified that error appears in the above-identified patent and that said Letters Patent is hereby corrected as shown below:

Column 3, line 65, for "particularlly" read --particularly--.

Column 7, line 61, for "admixtxure" read --admixture--.

Column 8, line 56, for "197+F" read --197$^{o}$F--.

Signed and Sealed this

Twenty-seventh Day of October, 1987

*Attest:*

DONALD J. QUIGG

*Attesting Officer*

*Commissioner of Patents and Trademarks*